US006066193A

United States Patent [19]

Lee

[11] Patent Number: 6,066,193

[45] Date of Patent: May 23, 2000

[54] TAPERED FLOW GAS SEPARATION SYSTEM

[75] Inventor: Woon Yung Lee, Bartlesville, Okla.

[73] Assignee: Camco International, Inc., Houston, Tex.

[21] Appl. No.: 09/137,976

[22] Filed: Aug. 21, 1998

[51] Int. Cl.[7] ..... B01D 19/00

[52] U.S. Cl. ..... 95/261; 96/196; 96/212; 96/214; 96/215; 96/216; 166/105.5

[58] Field of Search ..... 95/261; 96/177, 96/195, 196, 208, 209, 210, 211, 212, 213, 214, 215, 216; 166/105.5, 105.6

[56] References Cited

U.S. PATENT DOCUMENTS

| | | | |
|---|---|---|---|
| Re. 30,836 | 12/1981 | Bunnelle | 96/214 |
| 1,279,758 | 9/1918 | Putnam | 96/214 |
| 1,628,900 | 5/1927 | Neilsen | 96/214 |
| 1,655,817 | 1/1928 | Marsh | 166/105.5 |
| 2,674,192 | 4/1954 | Coberly | 96/211 |
| 2,718,308 | 9/1955 | Le Bus | 96/215 |
| 3,282,031 | 11/1966 | Vos et al. | 96/214 |
| 3,285,186 | 11/1966 | Tracy et al. | 96/215 |
| 3,624,822 | 11/1971 | Carle et al. | 96/214 |
| 4,088,459 | 5/1978 | Tuzson | 55/203 |
| 4,241,788 | 12/1980 | Brennan | 166/105.5 |
| 4,481,020 | 11/1984 | Lee et al. | 96/214 |
| 4,901,413 | 2/1990 | Cotherman et al. | 29/890.14 |
| 4,913,630 | 4/1990 | Cotherman et al. | 417/313 |
| 4,981,175 | 1/1991 | Powers | 166/265 |
| 5,389,128 | 2/1995 | Lopes | 96/207 |
| 5,474,601 | 12/1995 | Choi | 96/195 |
| 5,482,117 | 1/1996 | Kolpak | 166/265 |
| 5,516,360 | 5/1996 | Normandeau et al. | 96/214 |
| 5,525,146 | 6/1996 | Straub | 96/214 |
| 5,902,378 | 5/1999 | Obrejanu | 95/261 |

OTHER PUBLICATIONS

J.C. Ditria and M.E. Hoyack, "The Separation of Solids and Liquids With Hydrocyclone–Based Technology for Water Treatment and Crude Processing," SPE Paper No. 28815, Melbourne, Australia, Nov. 7–10, 1994.

J.S. Weingarten et al., "Development and Testing of a Compact Liquid–Gas Auger Partial Separator for Downhole or Surface Applications," SPE Paper No. 30637, SPE Production and Facilities, Feb. 1997.

*Primary Examiner*—Duane S. Smith

*Attorney, Agent, or Firm*—Fletcher, Yoder & Van Someren

[57] ABSTRACT

The present invention provides a submersible pumping system which includes a tapered flow gas separation system. The tapered flow gas separation system of the present invention includes at least a first and second gas separator. The first separator is configured to receive and process a first flow rate of production liquid. The first separator is adapted to draw production liquid from a production casing and to separate a first portion of gas from the production liquid. The second separator is configured to receive and process a second flow rate of production liquid which is less than the first flow rate received by the first separator. The second separator is adapted to receive the production liquid from the first separator and to separate a second portion of gas from the production liquid.

11 Claims, 4 Drawing Sheets

TAPERED FLOW GAS SEPARATION SYSTEM

BACKGROUND OF THE INVENTION

1. Field of the Invention

The present invention relates generally to submersible pumping systems, particularly those adapted for the separation of gas from liquids prior to the production of the liquid to the earth's surface.

2. Description of the Related Art

Submersible pumping systems are routinely used for the production of liquids, particularly hydrocarbons and water, to the earth's surface. These systems are particularly effective and efficient for producing liquids from those subsurface formations where liquids predominate over gas. In situations where gas is also present, the efficiency of the pumping process is frequently decreased because the pump tends to intake gas with the liquid causing the pump to cavitate. If enough gas is pulled into the pump, the pump may quit pumping liquid, a malady known as gas lock.

In gas lock, the pump fills with gas so that it does not generate sufficient pressure to pump the liquid to the surface, and flow stops. Resumption of pumping may be as simple as ceasing production so that the submersible pump can cycle or, in worse case situations, may require pulling the pumping system out of the production casing.

Cavitation and gas lock events are potentially traumatic to the workings of the submersible pumping system. These events can contribute to the wear and premature failure of both the pump and the motor, especially in combination with the excessive motor temperatures generated during gas lock episodes. Furthermore, it is costly in time and lost production whenever a submersible pump or motor must be serviced by pulling them from the well bore. Thus, avoidance of cavitation and gas lock increases pumping efficiency, reduces maintenance costs on the pump and motor, and decreases the cost of production of the target liquid.

Previously, single-stage gas separators have been used upstream of the pump in an effort to separate the gas from the liquid to be produced. Single-stage separators are most effective in formations having relatively low gas-to-liquid ratios. In these situations, gas separators have been effectively used to separate gas from the liquid before the liquid reaches the pump. Because gas and liquid are separated before reaching the pump, primarily liquid is fed to the pump, thus reducing the risk of cavitation and the possibility of gas lock and also maintaining the efficiency of the pumping process.

In formations having high gas-to-liquid ratios, the use of multiple-stage gas separators has been attempted. In this application, generally two gas separators are coupled in series upstream from the pump. These multiple-stage gas separators have not provided the desired results, particularly in high gas-to-liquid ratio formations.

Accordingly, an efficient and cost effective means is desired for the separation of gas from liquid for the production of the liquid of interest to the earth's surface, particularly from formations having a high gas-to-liquid ratio and those having a high flow rate.

SUMMARY OF THE INVENTION

In accordance with one aspect of the present invention, there is provided a separation system which addresses the deficiencies of previous multi-stage separation systems by compensating for the reduction in flow rate from the first separation stage into the second separation stage. The separation system of the present invention utilizes a first separator configured and adapted to receive and process a greater flow rate of production liquid than the second separator. Thus, the separation system of the present invention is designed for the decreasing flow rate of production liquid from the first separation stage to the second.

The present invention provides a submersible pumping system which is particularly well-suited for use in a subterranean well environment. In accordance with the present invention, the submersible pumping system may include a pump, a motor, a motor protector and a separation system. Other equipment may also be provided, such as instrumentation, and so forth. The separation system of the present invention includes at least two separators, preferably coupled in series. The first separator being configured to receive and process a first flow rate of production liquid. The first separator is also adapted to draw production liquid from a production casing and to separate a first portion of gas from the production liquid.

The second separator is configured to receive and process a second flow rate of production liquid less than the first flow rate received and processed by the first separator. The second separator is also adapted to receive production liquid from the first separator, to separate a second portion of gas from the production liquid, and to convey the remaining production liquid to the pump for production of the production liquid to the earth's surface.

In accordance with another aspect of the invention, a separation system for use with a submersible pumping system is provided which includes a first and second gas separator coupled in series where each separator is configured to be positioned within a production casing. The first separator is adapted to receive and process a first flow rate of production liquid from the production casing. The first separator is configured to have an intake section which is adapted to receive production liquid from the annulus formed between the separators and the production casing. The first separator also possesses an induction section which includes an inducer, a diffuser, and a centrifuge. Both the inducer and the centrifuge are rotatably coupled to a power transmission shaft. The inducer and the centrifuge arc adapted to separate a first portion of gas from the production liquid. The first separator also includes a production section which includes a flow divider which separates the production liquid into the second separator and directs the first portion of separated gas into the annulus.

The second separator is coupled to the first separator. The second separator is adapted to receive and process a second flow rate of production liquid. The second separator is configured to have an intake section for receiving the production liquid from the first separator. The second separator also is configured to have an induction section including an inducer, a diffuser, and a centrifuge. Both the inducer and the centrifuge are rotatably coupled to the power transmission shaft. The inducer and the centrifuge are adapted to separate a second portion of gas from the production liquid. The second separator also is configured to have a production section which includes a flow divider which directs the production liquid toward a pump and directs the second portion of separated gas into the annulus.

In accordance with another aspect of the invention, a separation system is provided which includes a plurality of separators including at least a first and second separator. The first separator is configured to receive and process a first flow rate of production liquid. The first separator is adapted to draw production liquid from a production casing and to separate a first portion of gas from the production liquid.

The second separator is configured to receive and process a second flow rate of production liquid which is less than the first flow rate received by the first separator. The second separator is adapted to receive the production liquid from the first separator and to separate a second portion of gas from the production liquid.

In accordance with another aspect of the invention, a method for the production of production liquid from subterranean formations is provided which includes the steps of: separating a first portion of gas from a first portion of production liquid in a first separator creating a second portion of production liquid having a lesser gas content than the first portion of production liquid; conveying the second portion of production liquid to a second separator; separating a second portion of gas from the second portion of production liquid in the second separator creating a third portion of production liquid having a lesser gas content than the second portion of production liquid; and conveying the third portion of production liquid to a pump for the production of the production liquid to the earth's surface.

BRIEF DESCRIPTION OF THE DRAWINGS

The foregoing and other advantages and features of the invention will become apparent upon reading the following detailed description and upon reference to the drawings in which.

DESCRIPTION OF SPECIFIC EMBODIMENTS

In formations having high gas-to-liquid ratios, the use of multiple-stage gas separators has been attempted. In this application, generally two gas separators are coupled in series upstream from the pump. These multiple-stage gas separators have not provided the desired results, particularly in high gas-to-liquid ratio formations. The reason for this failure is that each stage has previously been configured to intake the same volume, or flow rate, of production fluid. As the production liquid (including gas) passes from the first separating stage to the second, the second separating stage attempts to intake the same amount of production liquid as the first. Because the flow from the first separator into the second is necessarily less, the second separator may begin to intake air and to cavitate. The second separator then passes air or gas onto the pump which may starve the pump causing it to shut down.

The same situation may occur in situations where separators having identical flow ratings are operated in tandem for production of production liquid from high flow rate formations. The second of the two separators operating in tandem may cavitate, and convey air and gas to the pump, because the second separator attempts to intake the same amount of flow as the first. The result is decreased pumping efficiency and pump life.

The separation system of the present invention addresses the deficiencies of previous multi-stage separation systems by compensating for the reduction in flow rate from the first separation stage into the second separation stage. The separation system of the present invention utilizes a first high flow separator which is configured and adapted to receive and process a greater flow rate of production liquid than the second low flow separator. Thus, the separation system of the present invention is designed for the decreasing flow rate of production liquid from the first separation stage to the second.

Figure 1:
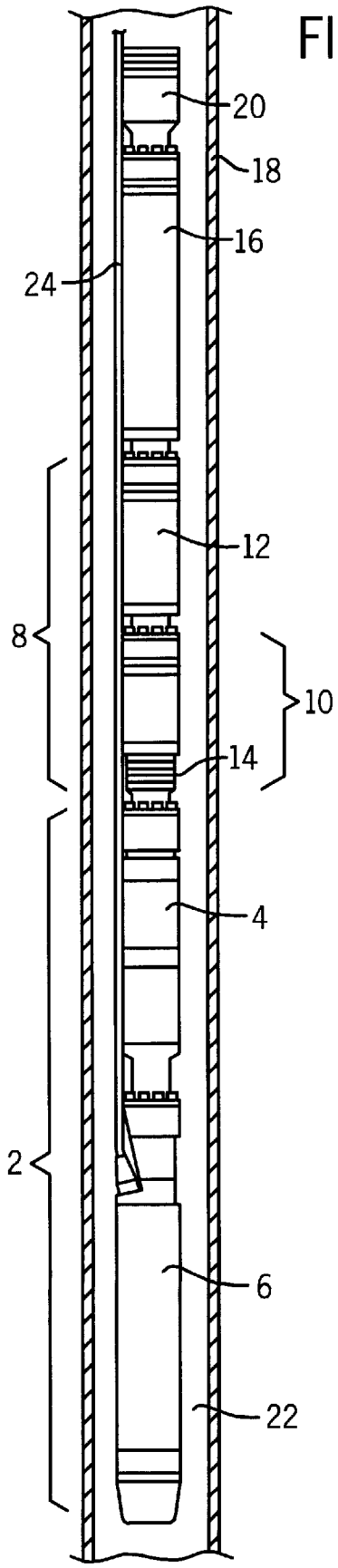
FIG. 1 is a vertical elevational view of an exemplary submersible pumping system including a motor, motor protector, separation system, and pump.

Referring to FIG. 1, a submersible pumping system is depicted as including a pump, a separation system, and a motor module. The motor module 2 is comprised of a motor protector 4 and a motor 6. The separation system 8 is comprised of a first separator 10 and a second separator 12. The first separator 10 is a high flow separator and includes an intake section 14. The pump 16 is coupled to the second low flow separator 12, which is in turn coupled to the first separator 10, which is in turn drivingly coupled to the motor 4, which is in turn coupled to the motor protector 6. The pump 16, second separator 12, first separator 10, the motor 4, and the motor protector 6 are disposed colinearly within the well casing 18 and suspended at an appropriate position within the well casing 14 by tubing 20. The positioning of the submersible pumping system depicted in FIG. 1 within the casing 18 creates an annulus 22. Electrical power is provided to the motor by means of a power cable 24. The liquid of interest to be pumped from the well by means of the submersible pumping system is gathered from the annulus 22 and produced to the surface through tubing 20.

Figure 4:
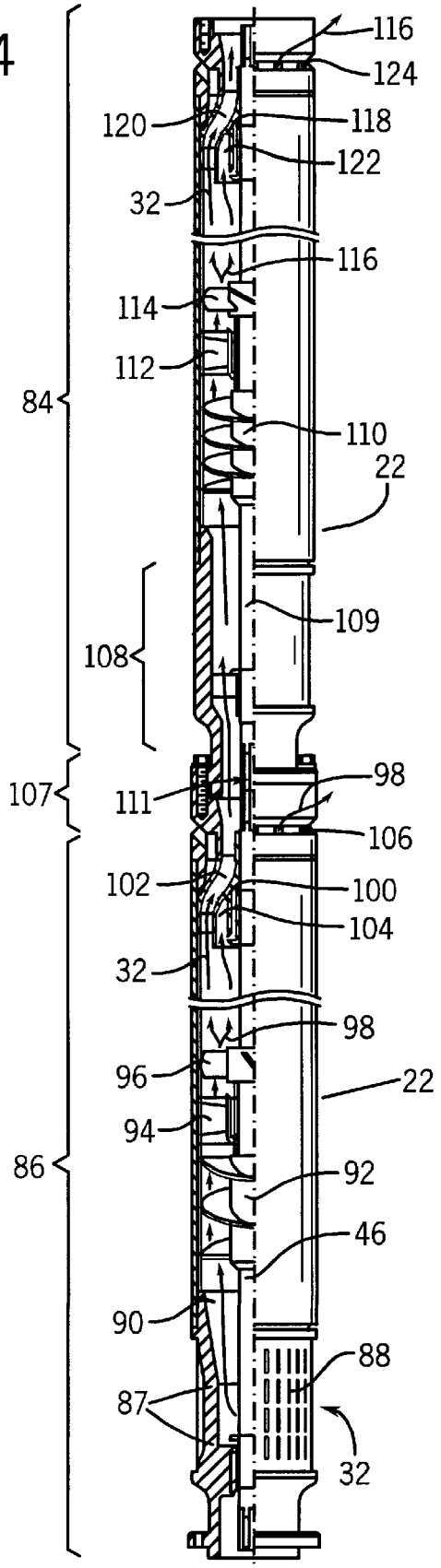
FIG. 4 is a vertical elevation partial sectional view of a separation system in accordance with the present invention.

As illustrated in FIG. 1, an embodiment of the separation system of the present invention includes at least a first and second separator of which the first separator is a high flow separator and the second separator is a low flow separator. Before describing the operation of the separation system of the present invention as illustrated in FIG. 4, the operation of a traditional low flow separator and of a high flow separator will be described.

Figure 2:
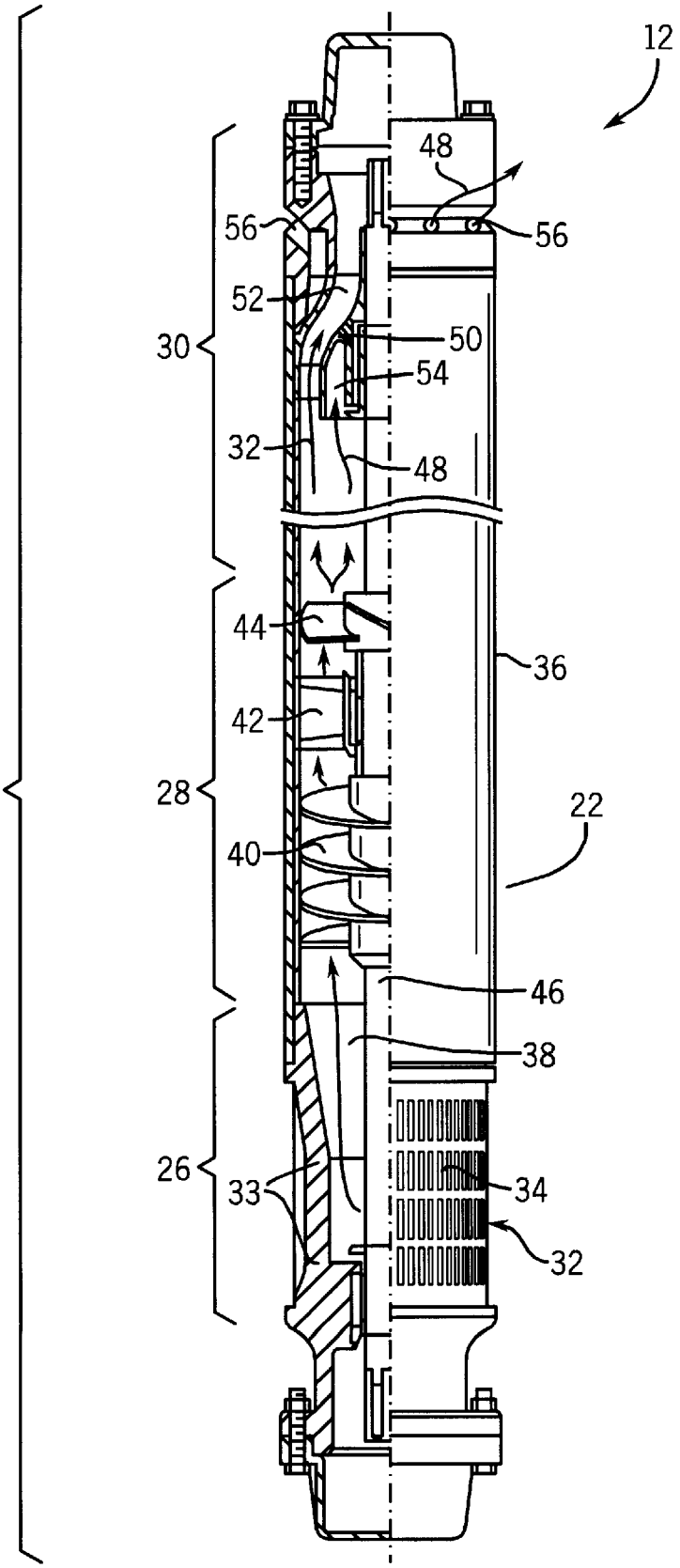
FIG. 2 PRIOR ART
FIG. 2 is a vertical elevation partial sectional view of a low flow gas separator.

FIG. 2 illustrates a traditional low flow gas separator 12 which may have the ability to receive and process from 2,000–8,000 barrels of production liquid per day. The low flow separator 12 illustrated in FIG. 2 includes three sections: an intake section 26, an induction section 28, and a production section 30. The low flow separator 12 receives production liquid 32 through the intake section 26 from an annulus 22 present between the low flow separator and a production casing (not shown).

For the purposes of the present invention, "production liquid" is defined as the liquid of interest which is sought to be produced to the earth's surface. In the subterranean formation where the "production liquid" is found, the liquid often contains gas which may be separated from the "production liquid" before it reaches the earth's surface.

The intake section 26 includes intake ports 33 and intake grate 34. The intake ports 33 allow the production liquid 32 to penetrate the shroud 36 housing the separator and thus to enter the separator. The intake ports 33 are spaced apart and disposed about the circumference of the shroud 36 in the intake section 26. Intake grate 34 is disposed about the circumference of the intake section 26 and is perforated about its circumference allowing for production liquid 32 to pass through intake grate 34, then through intake ports 33 and into the interior of the separator 38.

The induction section 28 includes an inducer 40, a diffuser 42, and a centrifuge 44. Both the inducer 40 and the centrifuge 44 are coupled to power transmission shaft 46. The diffuser 42 is stationary and acts as a bearing support for the rotating power transmission shaft 46.

After the production liquid 32 enters the interior of the separator 38, it encounters the inducer 40. The inducer 40, as configured in FIG. 2, resembles an auger having helical impeller blades radiating from a central supporting structure. The inducer 40 is coupled to the shaft 46 and thus rotates as the shaft 46 rotates. The inducer 40 may be coupled to the power transmission shaft 46 by any known means such as a conventional key and keyway structure. As the inducer 40 rotates, its helical impeller blades draw production liquid 32 into the inducer 40 where the pressure on the production liquid 32 is increased as it is conveyed toward the diffuser 42.

The diffuser 42 also acts to increase the pressure on the production liquid 32. Additionally, the diffuser 42 splits the flow of the production liquid 32 prior to its encountering the centrifuge 44. As illustrated in FIG. 2, diffuser 42 is stationary in relation to the rotating power transmission shaft 46 and thus also may act as a bearing support for shaft 46. In this embodiment, diffuser 42 has a blade-like form and may be held in place by a compression tube or similar retention device positioned above and below it wherein such retention devices engage the internal surface of the separator.

Diffuser 42 may be configured in any number of ways which are understood by those skilled in the art. Moreover, the presence of diffuser 42 is not necessary for the function of the separator.

The production liquid 32 next encounters the centrifuge 44. The centrifuge 44 is coupled to the shaft 46 and thus rotates as shaft 46 does. As it rotates, the centrifuge 44 imparts centrifugal force to the pressurized production liquid 32 causing the heavier liquid components of the production liquid to be forced outward away from the centrally positioned power transmission shaft 46 while the gaseous component 48 tends to remain in the center of a vortex created by the centrifugal force acting on the production liquid 32. The lighter gaseous component of the production liquid 48 is thus separated from the liquid component as a result of the centrifugal force.

As illustrated in FIG. 2, the centrifuge 44 is configured as a four-bladed propeller. The configuration of centrifuge 44 is not critical as long as it imparts centrifugal force on the production liquid 32. The centrifuge 44 may be coupled to the power transmission shaft 46 by any known means such as a conventional key and keyway structure.

The production liquid 32 and separated gas 48 then encounter the production section 30 of the separator. The production section 30 includes a flow divider 50. The flow divider 50 includes a channel 52 which directs the production liquid 32 toward a pump for production to the earth's surface and a channel 54 which directs the separated gas 48 into the annulus 22 through vent holes 56.

Figure 3:
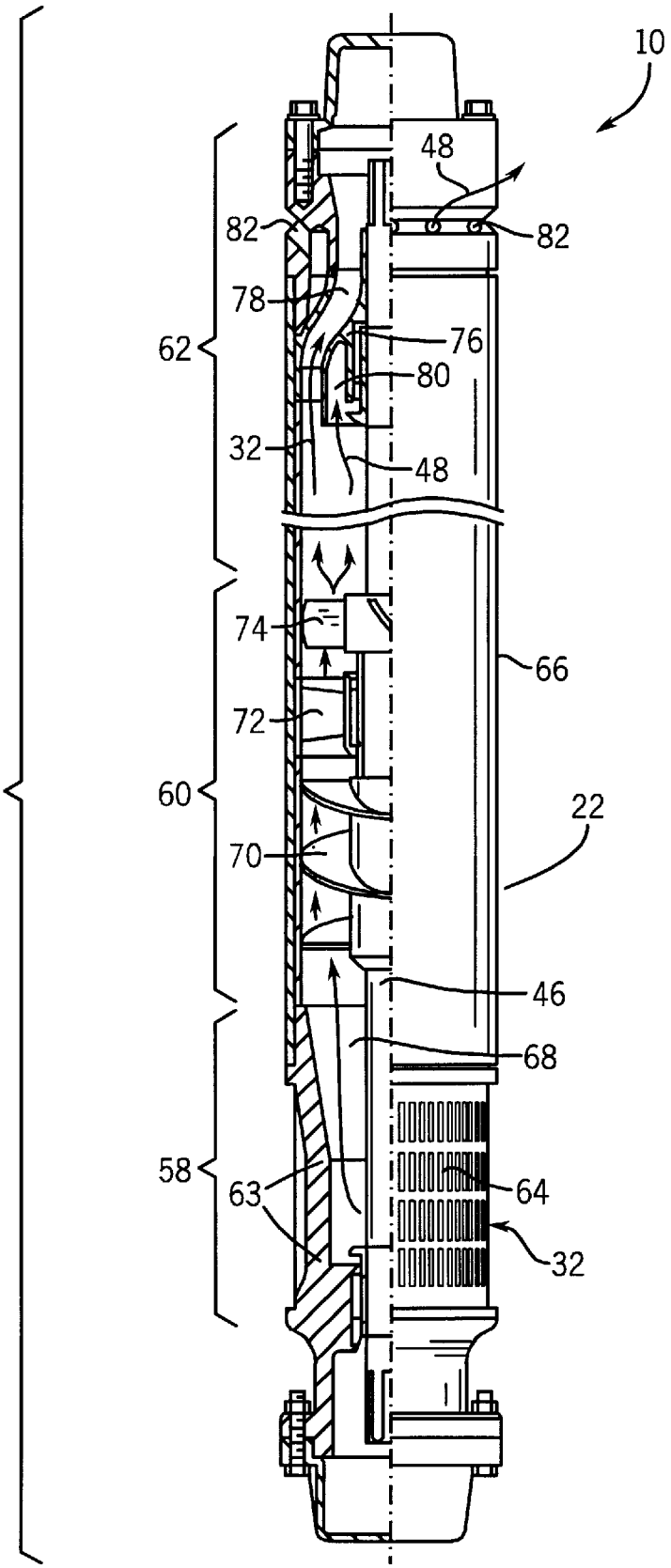
FIG. 3 PRIOR ART
FIG. 3 is a vertical elevation partial sectional view of a high flow gas separator.

FIG. 3 illustrates a high flow gas separator 10 which may have the ability to receive and process 7,000–15,000 barrels of production liquid per day. As with the low flow separator 12, the high flow separator 10 includes an intake section 58, an induction section 60, and a production section 62.

The intake section 58 includes intake ports 63 and an intake grate 64 which allow the production liquid 32 from annulus 22 (production casing not shown) to enter the separator. The intake ports 63 allow the production liquid 32 to penetrate the shroud 66 housing the separator and thus to enter the interior of the separator 68. The intake ports 63 are spaced apart and disposed about the circumference of the shroud 66 in the intake section 58. Intake grate 64 is disposed about the circumference of the intake section 58 and is perforated about its circumference allowing for production liquid 32 to pass through intake grate 64, then through the intake ports 63 and into the interior of the separator 68. Production liquid 32 then passes to the induction section 60.

Induction section 60 includes an inducer 70, a diffuser 72, and a centrifuge 74. Both the inducer 70 and the centrifuge 74 are coupled to power transmission shaft 46. The inducer 70 and the centrifuge 74 may be coupled to the shaft 46 by any acceptable means for example such as via a conventional key and keyway structure. The diffuser 72 is stationary and acts as a bearing support for power transmission shaft 46.

After the production liquid 32 enters the interior of the separator 68, it encounters the inducer 70. The inducer 70, as configured in FIG. 3, resembles an auger having helical impeller blades radiating from a central support structure. In the high flow separator of FIG. 3, inducer 70 has fewer helical impeller blades and the blades have a greater pitch than those of the low flow separator of FIG. 2. This configuration allows the inducer 70 of the high flow separator of FIG. 3 to accept and convey a higher flow rate of production liquid 32 than the inducer 40 of the low flow separator of FIG. 2. Nonetheless, inducer 70 and inducer 40 operate in the same manner. That is, as the helical impeller blades of inducer 70 rotate they draw production liquid 32 into the inducer 70 and increase the pressure on the production liquid 32 as it is conveyed toward the diffuser 72.

The diffuser 72 also acts to increase the pressure on the production liquid 32. Additionally, the diffuser 72 splits the flow of the production liquid 32 prior to its encountering the propeller 74. As illustrated in FIG. 3, the diffuser 72 is stationary in relation to the rotating power transmission shaft 46 and thus also may act as a bearing support for shaft 46. In this embodiment, the diffuser 72 has a blade-like form and may be held in place by a compression tube or similar retention device positioned above and below it wherein such retention devices engage the internal surface of the separator.

Diffuser 72 may be configured in any number of ways which are understood by those skilled in the art. Moreover, the presence of diffuser 72 is not necessary for the function of the separator.

The production liquid 32 next encounters the centrifuge 74. The centrifuge 74 is coupled to the shaft 46 and thus rotates as shaft 46 does. As it rotates, the centrifuge 74 imparts centrifugal force to the pressurized production liquid 32 causing the heavier liquid components to be forced outward away from the centrally positioned power transmission shaft 46 while the gaseous component 48 tends to remain in the center of a vortex created by the centrifugal force acting on the production liquid 32. The lighter gaseous component of the production liquid 48 is thus separated from the liquid component as a result of the centrifugal force.

As illustrated in FIG. 3, the centrifuge 74 is configured as four-bladed propeller. The propeller blades of centrifuge 74 have a greater pitch than those of centrifuge 44 in FIG. 2, making them more parallel to the flow of production liquid 32 through the separator. This difference in the configuration of the high flow separator of FIG. 3 as compared to the low flow separator of FIG. 2 also contributes to the ability of the high flow separator to accept and handle a greater flow rate of production liquid 32. The configuration of centrifuge 74 is not critical as long as it will accommodate the flow rate of the separator and it imparts centrifugal force on the production liquid 32. The centrifuge 74 may be coupled to the power transmission shaft 46 by any known means such as a conventional key and keyway structure.

The production liquid 32 and separated gas 48 then encounter the production section 62 of the high flow separator. The production section 62 includes a flow divider 76. The flow divider 76 includes a channel 78 which directs the production liquid 32 toward a pump for production to the earth's surface and a channel 80 which directs the separated gas 48 into the annulus 22 through vent holes 82.

FIG. 4 illustrates a separation system of the present invention which includes a modified low flow separator 84 (similar to FIG. 2) coupled to a high flow gas separator 86 (as shown in FIG. 3). In this embodiment of the present invention, the high flow separator 86 is drivingly coupled to a motor (not shown) positioned upstream from separator 86. Production fluid 32 is drawn from the annulus 22 (production casing not shown) through the intake ports 87 and intake grate 88 into the interior of the separator 90 by the action of the helical impeller blades of inducer 92. The inducer 92 also pressurizes and conveys the production liquid 32 toward the diffuser 94. The diffuser 94 further pressurizes the production liquid 32 while concurrently splitting the flow of the production liquid 32 prior to its encountering centrifuge 96. The centrifuge 96 imparts centrifugal force on the production liquid 32 thus separating from it a first portion of gas 98.

The production liquid 32 and the first portion of gas 98 are conveyed to the flow divider 100. The production fluid 32 is directed into channel 102 which conveys production liquid 32 into the second stage, or low flow, separator 84. The first portion of gas 98 is directed into channel 104 which vents through vent holes 106 into the annulus 22.

The second stage of the separation system of the present invention is modified low flow separator 84 which is coupled to high flow separator 86. Separators 84 and 86 may be coupled by any acceptable means such as interfacing flanges and bolts illustrated in coupling region 107. Shaft 46 in separator 86 may be coupled to shaft 109 in separator 84 by any acceptable means such as a splined connecting means 111. Thus, shaft 109 rotates as shaft 46 rotates.

Modified low flow separator 84 differs from the low flow separator of FIG. 2 primarily in the configuration of the intake section 108 of separator 84. In separator 84, rather than drawing production liquid 32 from the annulus 22, production liquid 32 is received directly from high flow separator 86 through production channel 102. Thus, separator 84 has no intake ports or intake grate.

The helical impeller blades of inducer 110 of the second stage separator 84 draw the production liquid 32 through the production channel 102 of separator 86 for further separation. The inducer 110 pressurizes and conveys the production fluid 32 toward diffuser 112. The diffuser 112 pressurizes the production liquid 32 and splits the flow of the production liquid 32 in preparation for encountering the centrifuge 114. The centrifuge 1 14 imparts centrifugal force to the production liquid 32 thus separating a second portion of gas 116 from it. The production liquid 32 and second portion of gas 116 next encounter flow divider 118. Production liquid 32 is directed into channel 120 which conveys the production liquid 32 directly into a pump (not shown). The second portion of gas 116 is directed into channel 122 which is vented into the annulus 22 through vent holes 124.

The first stage separator 86 is specifically adapted and configured to receive and process a greater flow rate of production liquid 32 than the second stage separator 84. For example, for use with a 5 inch pump, high flow separator 86 may have a flow rating of from 7,000–15,000 barrels of liquid/day, while modified low flow separator 84 may have a flow rating of from 2,000–8,000 barrels/day. The flow rate of production liquid 32 exiting first separator 86 should be substantially lower than the flow rate when it entered first separator 86. Thus, the reduced flow rate of production liquid 32 exiting first separator 86 should be able to be handled comfortably by second separator 84. Moreover, because second separator 84 is configured to receive and process the lower flow rate of production liquid 32 from first separator 86, cavitation should be minimized and thus pumping efficiency maximized. That is, by design, the separation system of the present invention specifically tapers the flow rate of production liquid 32 from the first stage separator to the second stage separator and into the pump. Consequently, incidents where gas or air are conveyed to the pump from the separation system should be decreased and the liquid content that is conveyed to the pump should be increased. By doing so, pumping efficiency should be increased and pump life likewise increased.

The flow rate differential between the first separator 86 and the second separator 84 may be accomplished in many ways. For example, two similarly configured separators may be used in tandem, however, with the second separator configured to have a smaller internal diameter than the first so that the flow rating of the second separator is effectively reduced.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A separation system for use with a submersible pumping system comprising:

a first and second gas separator coupled in series, each separator configured to be positioned within a production casing, including the first separator being adapted to receive and process a first flow rate of production fluid from the production casing, the first separator having an intake section which is configured to receive a first flow of production fluid at a first flow rate from an annulus between the separators and the production casing; an inducer section which includes an inducer, a diffuser, and a centrifuge, the inducer and the centrifuge being rotatably coupled to a power transmission shaft, the inducer and the centrifuge also being adapted to separate a first portion of gas from the first flow of production fluid; and a production section which includes a flow divider which directs the first flow of production fluid minus the first portion of separated gas into the second separator and directs the first portion of separated gas into the annulus; and the second separator coupled to the first separator, the second separator having a reduced capacity to receive and process a smaller flow rate of production fluid relative to the first separator, the second separator having an intake section for receiving the first flow of production fluid minus the first portion of separated gas from the first separator; an inducer section including, an inducer, a diffuser, and a centrifuge, the inducer and the centrifuge being rotatably coupled to a power transmission shaft, the inducer and the centrifuge also being adapted to separate a second potion of gas from the first flow of production fluid minus the first portion of separated gas; and a production section which includes a flow divider which directs the first flow of production fluid minus the first portion of separated gas and minus the second portion of gas towards a pump and directs the second portion of separated gas into the annulus.

2. The separation system of claim 1 wherein the first separator has a flow capacity in a first range of from about 7,000–15,000 barrels of production fluid per day and the second separator has a flow capacity in second range less than the first range.

3. The separation system of claim 1 wherein the inside diameter of the second separator is less than the inside diameter of the first separator.

4. A separation system for use with a submersible pumping system comprising:

a plurality of separators including, at least a first and a second separator, the first separator having a first capacity to receive and process a first flow rate of production fluid, the first separator being adapted to draw production fluid from a production casing and to separate a first portion of gas from the production fluid; and the second separator having a second capacity that is less than the first capacity to receive and process a second flow rate of production fluid that is less than the first flow rate, the second separator being adapted to receive the production fluid from the first separator and to separate a second portion of gas from the production fluid.

5. The separation system of claim 4 wherein the first and second separators are coupled in series.

6. The separation system of claim 4 wherein the inside diameter of the second separator is less than the inside diameter of the first separator.

7. The separation system of claim 4 wherein the first separator has a flow rating in a first range of from about 7,000–15,000 barrels of production fluid per day and the second separator has a flow rating in a second range less than the first range.

8. A submersible pumping system comprising:

a pump;

a first and second gas separator coupled in series, the second gas separator being coupled to the pump, including a first separator configured to receive and process a first flow rate of production fluid, the first separator being adapted to draw production fluid from a production casing and to separate a first portion of gas from the production fluid; and a second separator configured to receive and process a second flow rate of production fluid that is less than the first flow rate, the second separator being adapted to receive production fluid from the first separator, to separate a second portion of gas from the production fluid, and to convey the remaining production fluid to the pump;

a motor drivingly coupled to the first separator; and a motor protector coupled to the motor.

9. The submersible pumping system of claim 8 wherein the inside diameter of the second separator is less than the inside diameter of the first separator.

10. The submersible pumping system of claim 8 wherein the first separator has a flow rating in a first range of from about 7,000–15,000 barrels of production fluid per day and the second separator has a flow rating in a second range less than the first range.

11. A method for producing a production fluid from subterranean formations comprising the steps of:

receiving a first portion of production fluid at a first flow rate into a first separator;

separating a first portion of gas from the first portion of production fluid in the first separator to create a second portion of production fluid having a lesser gas content than the first portion of production fluid;

conveying the second portion of production fluid to a second separator having a power flow capacity;

utilizing a second separator to separate additional gas more efficiently at a lower flow rate than at the first flow rate;

creating a third portion of production fluid having a lesser gas content than the second portion of production fluid; and conveying the third portion of production fluid to a pump for production to the earth's surface.

* * * * *